United States Patent [19]

Gustafsson

[11] Patent Number: 4,704,672

[45] Date of Patent: Nov. 3, 1987

[54] METHOD AND ARRANGEMENT FOR VARYING A VOLTAGE OCCURRING BETWEEN THE ELECTRODES OF AN ELECTROSTATIC DUST SEPARATOR

[75] Inventor: Alf G. Gustafsson, Växjö , Sweden

[73] Assignee: Fläkt AB, Stockholm, Sweden

[21] Appl. No.: 734,267

[22] PCT Filed: Oct. 4, 1984

[86] PCT No.: PCT/SE84/00328

§ 371 Date: May 13, 1985

§ 102(e) Date: May 13, 1985

[87] PCT Pub. No.: WO85/01453

PCT Pub. Date: Apr. 11, 1985

[30] Foreign Application Priority Data

Oct. 5, 1983 [SE] Sweden ..... 8305486

[51] Int. Cl.[4] ..... B03C 3/66

[52] U.S. Cl. ..... 363/86; 361/235; 323/903; 55/105; 55/139

[58] Field of Search ..... 361/235; 363/86, 135; 55/103, 105, 139; 323/903

[56] References Cited

U.S. PATENT DOCUMENTS

| | | | |
|---|---|---|---|
| 4,284,417 | 8/1981 | Reese et al. | 55/105 |
| 4,486,704 | 12/1984 | Gustafsson et al. | 55/105 X |
| 4,490,159 | 12/1984 | Matts | 55/105 X |

FOREIGN PATENT DOCUMENTS

| | | | |
|---|---|---|---|
| GBX8170382 | 10/1981 | Australia . | |
| 535285 | 10/1981 | Australia . | |
| 1158296 | 12/1983 | Canada . | |
| 1004594 | 3/1957 | Fed. Rep. of Germany . | |
| 58-88047 | 5/1983 | Japan . | |
| 81/02691 | 10/1981 | PCT Int'l Appl. . | |
| 684226 | 12/1952 | United Kingdom . | |
| 2083253 | 3/1982 | United Kingdom . | |
| 1029-377 | 7/1983 | U.S.S.R. | 363/86 |

*Primary Examiner*—L. T. Hix
*Assistant Examiner*—D. Rutledge
*Attorney, Agent, or Firm*—Oblon, Fisher, Spivak, McClelland, & Maier

[57] ABSTRACT

Method and arrangement for varying a d.c. voltage occurring between electrodes of an electrostatic dust separator, said voltage being generated by a number of frequency-related pulses together forming a pulse train. A mains voltage (50 Hz) is fed via valve organs (8, 8*a*) controlled by a control circuit (7) to a transformer (T), the current pulses of which are full-wave rectified (9) and are connected to electrodes (10) of the dust separator. The control circuit (7) is so arranged as to extinguish an even number, being two, four or more, of pulses from the mains voltage between two consecutive pulses supplied to the electrodes of the dust separator.

Control circuit 7 is utilized to regulate the number of extinguished pulses and/or the pulse form of the individual pulse, so that with each pulse that is transferred to the electrodes there is also transferred to the filter that quantity of energy which is the maximum possible without producing flash-over or reverberation, in addition to which the control circuit (7) must be so arranged as to minimize the energy supply by controlling the length of the period between two consecutive pulses and by making this period as long as possible in relation to a limit value allocated to an opacimeter or similar.

5 Claims, 4 Drawing Figures

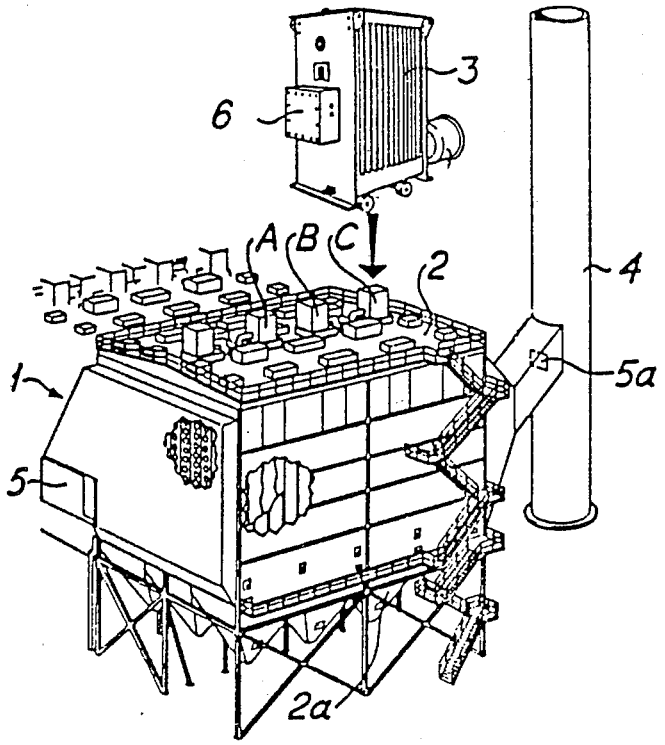
Fig. 1
Fig. 2
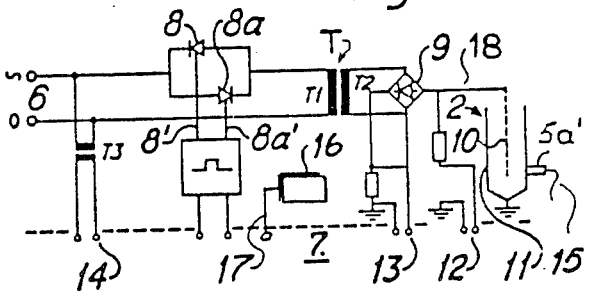

Fig. 3
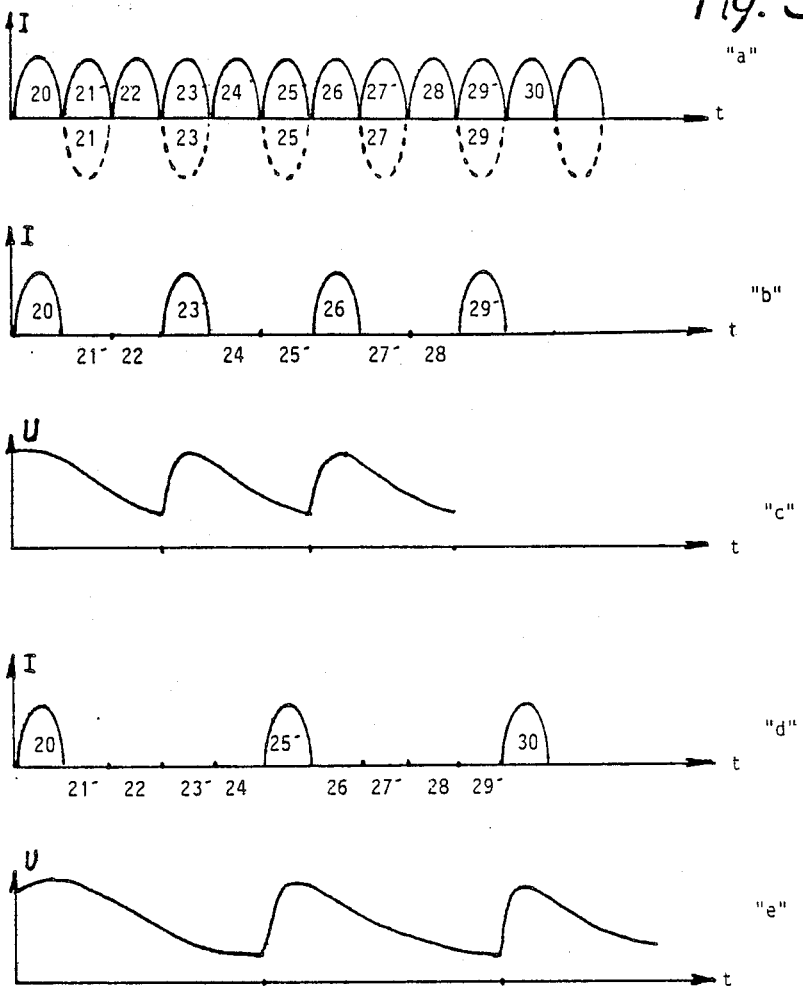
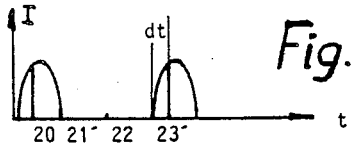
Fig. 4

METHOD AND ARRANGEMENT FOR VARYING A VOLTAGE OCCURRING BETWEEN THE ELECTRODES OF AN ELECTROSTATIC DUST SEPARATOR

TECHNICAL FIELD

The present invention relates on the one hand to a method and on the other hand to an arrangement permitting the simple variation of a voltage occurring between the electrodes of an electrostatic dust separator. This voltage is generated from a number of frequency-related current pulses which occur consecutively one after the other, in this way forming a pulse train.

DESCRIPTION OF THE PRIOR ART

Previously disclosed are electrostatic dust separators in which the voltage occurring between the electrodes of the dust separator is built up by supplying energy in the form of current pulses.

Also previously disclosed is the connection to the electrodes of the dust separator of a d.c. voltage on which is superimposed an a.c. voltage. The a.c. voltage in this case can have the form of pulses.

As an example of the prior art of the first mentioned kind reference may be made to the arrangement illustrated and described in English Patent Specification No. 728 061. Conditions have been created in this arrangement for the electrostatic separation of particles from a flow of gas passing over the electrodes by causing the voltage to vary within a range of frequencies of between 20 and 120 pulses per second, and by connecting between the pulses a positive potential of relatively small amplitude.

As an example of the prior art of the next mentioned kind reference may be made to the arrangement illustrated and described in Amer. U.S. Pat. No. 4,138,233. Presented here are various possibilities for the superimposition of pulses over a first level of d.c. voltage or for the connection of various a.c. voltages to said level of d.c. voltage, in this way attempting to render the dust separation more effective. What is shown here is that the d.c. voltage has superimposed on it square pulses, a complete sinusoidal oscillation, a half-wave rectified voltage or a periodically occurring complete sinusoidal oscillation. Reference is also made to the variation of the peak value, the pulse width and/or the periodicity.

Also previously disclosed is the superimposition on a d.c. voltage of individual pulses by utilizing an oscillating circuit, at the same time making use of control circuits to ensure that only one of the oscillating pulses will be supplied to the dust separator. The time between consecutive individual pulses is selected so as to be large, and returned energy from the dust separator is stored in a storage capacitor. As an example of the prior art in this respect reference may be made to an arrangement illustrated and described in U.S. Pat. No. 4,052,177.

Thus it may be established that a large number of proposals has already been disclosed relating to the variation of the voltage in a dust separator, and in respect of the energy supply via current pulses individual pulse lengths ranging from a few microseconds to tens of milliseconds have been proposed.

Also part of the prior art is the arrangement illustrated and described in English Patent Specification No. 684 226 in which the length of the period between two consecutive pulses is either 'zero' or two pulses.

DESCRIPTION OF THE PRESENT INVENTION

Technical Problem

Against the background of what has previously been disclosed, it is clear that it must be a particularly challenging technical problem to create voltage conditions in the electrostatic dust separator and to select a variation in the supply of pulsed current such that a desired degree of cleaning will stand in a reasonable relationship to the cost of the control circuit and the other equipment which is to generate the necessary and appropriate variation in the voltage.

A particularly challenging technical problem is also encountered in conjunction with the creation of conditions such that a pre-determined degree of separation or degree of cleaning can be achieved, and such that the degree of cleaning can be regulated in a simple and efficient manner by the evaluation of easily accessible parameters.

A particularly challenging technical problem is also encountered in conjunction with the creation of conditions such that the energy requirement of the dust separator is in relation to the separation, and such that the regulation of the energy requirement is straightforward. In addition, there is a wish for the energy requirement to be low in relation to the degree of separation.

A particularly challenging technical problem is also encountered in conjunction with the creation of conditions such that the transformer required for the generation of the voltage in the dust separator can be dimensioned in a simple fashion, and such that measures can be implemented to reduce losses in the transformer in spite of the control of the current pulses.

A particularly challenging technical problem is also encountered in connection with the conditions indicated above in creating an arrangement which is capable in a simple fashion of regulating the supply of pulsed current to the electrostatic dust separator, and in addition in achieving simple regulation dependent on signals received from an opacimeter.

A particularly challenging technical problem is also encountered in conjunction with the creation of simple conditions for the regulation of the energy supply to the dust separator, and with the creation of a sufficiently high voltage in the dust separator without separate circuits being required for this purpose for the supply of a direct current.

A particularly challenging technical problem is also encountered in conjunction with the creation with the help of control circuits of a pulse form, or with the modulation of an existing pulse in such a way that the pulse energy in each pulse will be matched in such a way that the resulting voltage in the dust separator will not produce flash-over, or that reverberation will not occur.

A problem is also encountered in ensuring that the regulation of the dust separator can take place in a simple fashion on the one hand by selecting the length of the period between pulses with a high energy content, the length of said period being dependent upon an even number of extinguished pulses, and on the other hand by selecting a previously disclosed modulation of the energy content in each of the pulses concerned.

A particularly challenging technical problem is encountered in conjunction with the ability to ensure that the control circuit is so arranged as to be capable of regulating the number of extinguished pulses and, if necessary, also the pulse form of the individual pulses, so that each pulse that is transferred to the electrodes will transfer to the filter that quantity of energy which is the maximum possible without producing flash-over or reverberation, at the same time minimizing the energy supply by making the length of the period as long as possible in relation to a limit value allocated to an opacimeter or similar.

Solution

Now the present invention proposes a method and an arrangement permitting the variation of a voltage occuring between the electrodes of an electrostatic dust separator, said voltage being generated by a number of frequency-related pulses together forming a pulse train.

In accordance with the invention it is proposed that the variation of the voltage shall be possible by so arranging a control circuit as to extinguish an even number of pulses, in such a way that the length of the period between two consecutive individual pulses will be determined by an even number of extinguished pulses.

The invention also proposes that the mains voltage shall be fed via a control circuit to a transformer, the output voltage or current pulses of which are full-wave rectified, and that the generated current shall be fed to the electrodes of the dust separator. For an arrangement of this kind the invention proposes that the control circuit shall be so arranged as to extinguish an even number of pulses between the two consecutive individual pulses fed to the electrodes of the dust separator. In this case the number of pulses extinguished may be two, four or more.

The control circuit may in a previously disclosed fashion also be so arranged that any pulses and energy fed to the electrodes of the dust separator will be regulated by regulating the energy content of each individual pulse. For this purpose the amplitude value and/or the duration of the pulse may be regulated.

In accordance with the present invention allowance may be made in the dimensioning of the transformer used for the fact that the only current pulse passage supplied via the transformer will be of the kind in which one pulse passes in one direction and the following pulse passes in the opposite direction. Thus it is possible in this way to obtain an increased current from an existing transformer, or in the case of a new installation the transformer may be made smaller than was previously necessary since the transformer will operate only for part of the time.

The invention also proposes the possibility of creating by means of an opacimeter conditions such that the control circuit will be controlled in the event of decreasing opacity in such a way that an increased number of extinguished and even pulses will occur between two pulses connected to the dust separator, and vice versa.

The invention furthermore proposes that, in the event of a reduced quantity of dust entering the dust separator, the control circuit shall be so arranged as to increase the number of extinguished even pulses between two pulses connected to the dust separator, and vice versa.

It is, of course, possible in the event of smaller demands being imposed on the degree of regulation to regulate only the energy content of the pulse.

The invention finally proposes that the control circuit shall be so arranged as to be capable on the one hand of regulating the number of extinguished even pulses, but to be capable, if so required, on the other hand of regulating the pulse form of the individual pulse. Regulation in this case shall be achieved in such a way that, with each pulse that is transferred to the electrodes, there will also be transferred to the filter that quantity of energy which is the maximum possible without producing flash-over or reverberation, but at the same time minimizing the energy supply by making the length of the period as long as possible in relation to a limit value allocated to the opacimeter or similar.

Advantages

Those advantages which may principally be regarded as being characteristic of a method and an arrangement in accordance with the present invention are that conditions are created in this way permitting the control and variation in a simple fashion of the voltage occurring between the electrodes of an electrostatic dust separator, and that an increased degree of separation is achieved in the dust separator in return for a lower energy requirement without the need for pulse-generating circuits. Finally, it has been found that the arrangement proposed in accordance with the invention offers the opportunity of under-dimensioning the transformer by comparison with previously disclosed techniques.

Since the voltage in the dust separator is built up simply with the help of mains frequency-related pulses, it is possible to eliminate the previously disclosed separate d.c. circuits with rectifiers, etc., intended for the basic level of the d.c. voltage, at the same time as separate oscillating circuits for the creation of superimposed pulses are eliminated.

BRIEF DESCRIPTION OF THE DRAWINGS

A preferred embodiment exhibiting the characteristic features of the present invention is described below in greater detail with reference to the accompanying drawing, in which:

FIG. 1 shows in perspective view a dust separator comprising a number of units connected one after the other (in series), but having only one transformer/rectifier unit intended for a unit shown in exploded view above the rest of the dust separator;

FIG. 2 shows a block diagram for the transformer/-rectifier unit;

FIG. 3 shows various time diagrams for the current and voltage, in which:

- 'a' indicates the current pulses generated by the mains frequency which are capable without the need for regulation of being fed to the electrodes of the dust separator, where they build up the voltage occurring there;
- 'b' indicates a first current pulse regulation in accordance with the present invention;
- 'c' indicates the voltage variation in the dust separator for a current pulse regulation as indicated in 'b';
- 'd' indicates a second current pulse regulation in accordance with the present invention; and
- 'e' indicates the voltage variation in the dust separator for a current pulse regulation as indicated in 'd'; and FIG. 4 shows a previously disclosed regulation of the pulse energy, which may be utilized with advantage in combination with the regulation in accordance with FIG. 3 'b' and 'd'.

DESCRIPTION OF THE PREFERRED EMBODIMENT

With reference to FIG. 1 is illustrated in perspective view an example of an electrostatic dust separation plant 1 consisting of a number of parallel flue-gas chambers, each provided with four electrode groups. Each of these electrode groups, for example A, B and C, requires a transformer/rectifier unit, although only the unit intended for electrode group 2 or C is illustrated in FIG. 1, where it has been allocated the reference designation 3. The current supply is provided via a cable or lead 6. The positioning of the electrode groups is, in principle, such that the outlet from one group is connected directly to the inlet for the following group, and so on. Since group 2 constitutes the last group, its outlet is connected to a chimney 4.

Although the dust separator illustrated here consists of a number of electrode groups, there is nothing to prevent each group from being in the form of an electrostatic dust separator.

The dust separating plant 1 is of the type in which particle-laden air is channelled to an inlet 5 and is caused to pass into the first electrode group. In this, as in the others, the particles are electrically charged by the electrical field produced by the voltage between adjacent plate electrodes and interjacent emission electrodes by connecting a high negative d.c. voltage to the emission electrodes. A particle of dust entering this field will be given a negative electrical charge, and this particle will then be attracted by the positively charged emission electrode, resulting in an accumulation of particles on the plates. The air which has been cleaned by the electrode groups one after the other will then pass out via the outlet 5*a* to the chimney 4.

Electrically charged dust particles will be caused by the electrical field to be deposited mainly on the plates, where they will build up a coating. Once this coating has reached a certain thickness, the coating is shaken from the plates mechanically, causing it to drop down. Particles which have collected in the dust separator 2 are thus collected normally in collecting bins or in a particle collecting unit 2*a* constructed in the base of the dust separator.

With reference to FIG. 2 is illustrated a simplified wiring diagram for a transformer/rectifier unit, from which it can be appreciated that the a.c. supply lead 6 is connected to two opposing valve organs in the form of thyristors 8, 8*a*, each of which is connected to its own control electrode 8', 8*a'*, which are connected to a control arrangement or control circuit 7 not described in detail in FIG. 2, but nevertheless indicated there in schematic form.

Control circuits of this kind have been previously disclosed, although it is proposed that the control circuit 7 should be in the form of a control circuit as described in greater detail in U.S. Pat. No. 4,486,704.

The program will, of course, have to be modified in this case to bring it into line with the special characteristics referred to in this Specification. The modification has not been described in any great detail, since it is a familiar procedure to an expert.

The control circuit 7 is so arranged as to be able at the appropriate time to control signals occurring in the leads connected to the control electrodes 8', 8*a'*, in this way allowing either all or part of the mains frequency-related pulses to pass. This regulation provides control of the current which passes an inductance T, contained in a transformer with windings 'T1' and 'T2'. The primary winding 'T1' of the transformer interacts with the secondary winding 'T2' of the transformer, which constitutes the high-voltage side and is connected to a rectifier bridge 9 connected on the high-voltage side. When these current pulses are connected to the emission electrode 10 in the dust separator 2 a negative voltage will be produced there which may be regarded as having been rectified and equalized because of the capacitance present between the earthed plate electrode 11 and the emission electrode 10. When current pulses having the shape illustrated in FIG. 3 '*a*' (or controlled in accordance with FIG. 4) are connected to the electrodes, a d.c. voltage corresponding to the energy content of the pulse will be produced. The instantaneous energy content of the pulses will thus be determined more or less by the instantaneous d.c. voltage value.

The control circuit 7 requires for the purpose of controlling the instantaneously occurring d.c. value in the dust separator information in respect of the instantaneously occurring d.c. voltage and d.c. current values. The instantaneously occurring d.c. voltage value can be evaluated via a lead 12, whilst the instantaneously occurring d.c. current value can be evaluated via a lead 13. The passages through zero of the a.c. voltage supply can be evaluated via a lead 14.

The principal task of the control circuit 7, as shown in FIGS. 1 and 2, is thus to control at the appropriate time the signals in the leads 8' and 8*a'*, in this way permitting the regulation of the d.c. voltage values which are to occur in electrode group 2. The d.c. voltage value can thus be set to a pre-determined first level. This first level is variable in itself and is capable of time-related variation, and must be set to a high value at all times. A suitable level is referred to as 'on-set' or the voltage value for 'Corona-start'.

A circuit of the kine illustrated in FIG. 2 is thus connected to each of the various electrode groups which are included in the plant 1.

Information relating to the degree of cleaning in the quantity of air discharged can be evaluated via a sensor 5*a'* of a previously disclosed type positioned in the outlet 5*a* in the form of an opacimeter which, in order to produce the best results, should be connected directly to the control arrangement 7 via a connecting lead 15. Via a unit 16 and a lead 17 the contol circuit 7 can obtain information relating to the quantity of dust introduced in relation to the loading data or to the generation of dust, thereby enabling the control circuit to be so arranged as to control the supply of energy in relation to signals received from the unit 16.

The present invention is based on experiences gained from the practical operation of a dust separator. It has, in actual fact, been found that the dust separation process can be improved so as to use less energy by supplying the dust separator with current pulses with a large energy content and by selecting a large duration for the period between consecutive individual pulses.

With reference to FIG. 3 are illustrated a number of time diagrams for the current and the voltage. FIG. 3 '*a*' indicates the current pulses which can occur in a financially unattractive fashion in the lead 18 in order to produce the voltage present between the electrodes 10 and 11. This arrangement is in itself previously disclosed, and also previously disclosed is the reduction of the energy supply by the use of the transistor 8, 8*a* by chopping the pulses and in so doing also reducing the level of the d.c. voltage in the dust separator.

The supply voltage in the lead 6 has a frequency of 50 (or 60) Hz and is sinusoidal. Via the thyristors 8, 8*a*, which are assumed to be open, the half-waves 20, 21, 22, etc., up to 30 will pass through the transformer with the windings T1 and T2, and a reversal of the magnetization of the magnetic flux of the transformer will occur for each half-wave.

By connecting the high-voltage winding T2 to a full-wave rectifier 9, the positive current pulses 21, 23, 25, 27 and 29 will be turned into negative current pulses 21', 23', 25', 27' and 29'.

This means that those current pulses which occur in the lead 18, with the thyristors 8, 8*a* open, will form a d.c. voltage in the dust separator, and that all the current pulses will be in the form of a single pulse train which is frequency-related to the frequency of the supply voltage present in the lead 6.

The current pulses connected to the electrodes 10, 11 are thus generated from a number of frequency-related pulses, together forming a pulse train consisting of the pulses 20, 21', 22, 23', 24, 25' and so on.

Whereas it has now become desirable to produce a variation in the current pulse train and thus a lower d.c. voltage in the dust separator, an arrangement has been previously disclosed whereby the pulses 21', 23', 25' can be blocked so that only half the energy supply is provided.

A regulation process of this kind suffers from the disadvantage, however, that the magnetization losses in the transformer T with the windings T1, T2 are high, and the present invention proposes the possibility that the variation shall be capable of taking place by causing the period between two consecutive pulses, as indicated in FIG. 3 '*b*', with the reference designation 20, 23', 26 and 29' to consist of an even number of extinguished pulses, these being the pulses 21', 22, 24, 25' and 27' 28.

A regulation process of this kind means that each current pulse used will produce a reversal of the direction of the magnetic flux in the transformer T. The current pulse 20 produces one direction of flow, and the current pulse 21 would have produced an opposite direction of flow had it not been blocked, the current pulse 22 should produce a direction of flow similar to the current pulse 20 although it is blocked, and the current pulse 23 is allowed to pass and produces an opposite direction of flow in relation to the current pulse 20.

The driving of current pulses through a transformer which at the same time generates a flow in only one direction produces high magnetization losses, which can be eliminated by following the directions in accordance with the present invention.

If the further downward regulation of the energy supplied is required, it is proposed that the pulse 23' should also be extinguished, and that the pulse 25' should be allowed to pass in order to build up the voltage between the electrodes of the electrostatic dust separator. In this case four pulses 21', 22, 23' and 24 will have been extinguished between pulse 20 and 25'.

The arrangement proposed in accordance with the invention for varying the voltage occurring between the electrodes of an electrostatic dust separator is thus based on the principle of causing the control circuit 7 to be so arranged as to extinguish an even number of pulses between two consecutive separate pulses in a pulse train supplied to the electrostatic dust separator.

It should also be noted at this point that the mains voltage 6 is fed via the control circuit 7 and the thyristors 8, 8*a* to a transformer T with windings T1, T2, the output voltage from which is full-wave rectified in the rectifier circuit 9 and is connected to the electrodes of the dust separator. The control circuit 7 is in this case so arranged as to extinguish an even number, being two, four or more, of pulses between two consecutive pulses in the pulse train supplied to the electrodes of the dust separator.

In FIG. 3 '*c*' is indicated the voltage variation in the dust separator when this is supplied with current pulses in accordance with FIG. 3 '*b*'.

In FIG. 3 '*d*' is indicated a current pulse regulation with a lower energy supply than that illustrated in FIG. 3 '*b*' and with four extinguished pulses, and in FIG. 3 '*e*' are indicated the voltage variations in the dust separator for a current pulse regulation of this kind.

The control circuit 7 is naturally executed in such a way as also to be capable of regulating the energy content of the individual pulse. This is done by entering at the appropriate time and controlling the thyristors 8, 8*a*. In FIG. 4 is illustrated the manner which the thyristors 8, 8*a* have extinguished part of the half-wave and are supplying only the non-sectioned component, which should thus produce a rather lower voltage in the dust separator and a flatter discharge curve.

This means that voltage variations between those indicated in FIG. 3 '*c*' and FIG. 3 '*e*' can be achieved simply by means of a pulse modulation in accordance with FIG. 4. This pulse modulation is able to be concentrated on the one hand on the energy content of the individual pulse, and on the other hand on the amplitude and/or pulse width of the individual pulse.

It is also proposed in accordance with the invention that the transformer T should be capable of being dimensioned only for a current pulse passage of the kind in which one pulse passes in one direction and the following pulse passes in thwe opposite direction with extinguished pulses in between so as to reduce in this way the losses in the transformer.

The invention also proposes that an opacimeter should be so arranged that, in the event of decreasing opacity, it will increase the number of extinguished even pulses between two pulses connected to the dust separator, and vice versa.

In addition, in the event of a reduced quantity of dust entering the dust separator as a result of lower loading data and reduced dust generation, the control circuit 7 can also be so arranged as to increase the number of extinguished even pulses between two pulses connected to the dust separator, and vice versa.

It is, of course, also possible via the control circuit 7 to modulate the pulse form to the desired shape.

The invention also proposes a method permitting the variation of a d.c. voltage occurring between the electrodes of an electrostatic dust separator, said d.c. voltage being generated by a number of frequency-related pulses together forming a pulse train. It is proposed in accordance with the invention that the variation shall take place by causing the length of the period between two consecutive separate pulses to be determined by an even number of extinguished pulses. It is also appropriate to cause the frequency-related pulses to be selected with a frequency corresponding to the mains frequency.

The length of the period between two consecutive pulses will be exactly the same as the duration of an even number of extinguished pulses if the full quantity of energy in each pulse is to be transferred (FIGS. 3 '*b*' and 3 '*d*'). If the energy content is regulated, for example by amplitude modulation and/or pulse width modulation (in accordance with FIG. 4), the duration will be somewhat longer and will, in fact, be extended by the time 'dt' shown in FIG. 4. At a main frequency of 50 Hz the maximum pulse duration will be 10 ms.

The present invention is thus based on the finding that an energy supply to the filter in accordance with FIG. 3 '*a*' is both financially unattractive and fails to provide the expected degree of cleaning.

The invention proposes in principle that a small number of pulses with high energy and with a long period between them will produce better economy as a result of the lower energy consumption and the higher degree of cleaning.

The control circuit 7 must accordingly be so arranged as to regulate the number of extinguished pulses and/or the pulse form of the individual pulse so that with each pulse that is transferred to the electrodes and the filter there is also transferred to the filter that quantity of energy which is the maximum possible without producing flash-over or reverberation.

The control circuit 7 must also be so arranged as to minimize the energy supply by controlling the length of the period between two consecutive pulses and by making this period as long as possible in relation to a limit value allocated to the opacimeter or similar.

The invention is not, of course, restricted to the embodiment indicated above by way of example, but may undergo modifications within the context of the following Patent Claims.

I claim:

1. A method for controlling a voltage occurring between electrodes of an electrostatic dust separator, comprising the steps of:

generating a pulse train including a plurality of main frequency-related pulse width modulated pulses;

varying the magnitude of said voltage occurring between said electrodes by passing on to said electrode a set of said generated pulses wherein said set of generated pulses is such that the length of the period between the end of any one pulse of said set of pulses and the start of a subsequent one pulse of said set of pulses is equal to the length of an even number of extinguished pulses related to a complete main frequency-related pulse and the reduced part of said pulse width modulated pulse.

2. The method according to claim 1, wherein the step of generating said pulse train includes the step of regulating the energy content of each of said plurality of pulses.

3. The method according to claim 1, wherein the step of generating said pulse train further includes the step of modulating the pulse form of each of said pulses supplied to said electrodes of said dust separator.

4. The method according to claim 1, including the step of regulating the quantity of energy transferred by said pulses to be of a maximum value without producing flash-over or reverberation by at least one of regulation of said length of said period and the pulse form of each of said plurality of pulses of said pulse train.

5. A control device for an electrostatic dust separator having electrodes, an A.C. power supply with rectifiers to generate intermittent power impulses, and means to convert said power impulses to direct current which is supplied to said electrodes and wherein said control device further has a first means sensing the level of the direct current in said separator, second means sensing the D.C. Voltage in the separator, third means sensing the zero point in the A.C. voltage of said A.C. power supply and a control circuit coupled to said first, second and third sensing means so that in response to actual direct current and actual D.C. current in the separator and time-related to said zero points in said A.C. voltage, said control circuit provides a specific time duration for the power impulses through said rectifiers and generates switching pulses to be fed to said rectifiers wherein said rectifiers are fed with said switching pulses in order to control said A.C. power supply being fed through said rectifiers and wherein the output of said voltage fed through said rectifiers controlled by said control circuit output is fed to one side of a transformer wherein the other side of said transformer is fed to a bridge rectifier wherein the output of said bridge rectifier is connected to said electrodes of said dust separator and wherein said control circuit includes a means to extinguish an even number, wherein said even number is at least 2, of pulses from said power supply between two consecutive individual pulses supplied to said electrodes of said dust separator.

* * * * *